US007114223B2

(12) United States Patent
Okot

(10) Patent No.: US 7,114,223 B2
(45) Date of Patent: Oct. 3, 2006

(54) COVERED ZIPPER PULL ASSEMBLY

(75) Inventor: Alex W. Okot, Amsterdam (NL)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/988,893

(22) Filed: Nov. 15, 2004

(65) Prior Publication Data

US 2006/0101625 A1 May 18, 2006

(51) Int. Cl.
*A44B 19/30* (2006.01)

(52) U.S. Cl. ..... 24/424; 24/421; 24/420; 24/419

(58) Field of Classification Search ..... 24/429, 24/421, 424, 433, 420, 422, 419, 415; 70/68
See application file for complete search history.

(56) References Cited

U.S. PATENT DOCUMENTS 5,848,455 A * 12/1998 Ikehara et al. ..... 24/422
6,332,249 B1 * 12/2001 Oda et al. ..... 24/421
6,499,200 B1 * 12/2002 Yamagishi et al. ..... 24/429
6,647,599 B1 * 11/2003 Lin ..... 24/421
6,928,703 B1 * 8/2005 Petravic et al. ..... 24/68 R
2004/0020017 A1 * 2/2004 Nedbal et al. ..... 24/429

FOREIGN PATENT DOCUMENTS

WO WO 03/082041 10/2003

* cited by examiner

*Primary Examiner*—Robert J. Sandy
*Assistant Examiner*—Marcus Menezes
(74) *Attorney, Agent, or Firm*—Banner & Witcoff, Ltd.

(57) ABSTRACT

A zipper assembly includes a pair of zipper tapes and a slider movable along the zipper tapes. A closure member and a zipper pull are connected to the slider. A cover for the zipper pull includes a housing having an aperture formed therein. A plunger rod having a first end and a second end is connected to the zipper pull, with its first end extending outwardly through the aperture. A biasing member biases the plunger rod outwardly from the aperture in a static condition.

32 Claims, 4 Drawing Sheets

COVERED ZIPPER PULL ASSEMBLY

FIELD OF THE INVENTION

This invention relates generally to a zipper pull assembly, and, in particular, to a zipper pull assembly having a hidden closure assembly and a cover.

BACKGROUND OF THE INVENTION

Articles of apparel, luggage, backpacks, sporting equipment and other items use closure assemblies, such as drawstrings, straps, cords, etc., to tighten or otherwise adjust a portion of the article. For example, hooded coats and sweatshirts often incorporate a drawstring to tighten the hood about the user's face and head. However, drawstrings can create safety concerns when near the neck of a wearer.

To address this issue and other concerns, zippers have been developed that incorporate a hidden closure assembly, such as a drawstring, beneath the zipper tape. The zipper stays sealed on either side of the zipper pull, thereby covering the drawstring or other closure assembly at all times.

Typical zipper pulls for invisible zippers are thin planar plastic or metal members, which are pivotally secured to a slider. To operate the zipper, the user grasps the pull between the thumb and forefinger and pivots it outwardly away from the slider. The user can then operate the zipper to open or close the device to which the zipper is attached. The zipper pull, however, may present sharp edges.

It is an object of the present invention to provide a covered zipper pull that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a covered zipper pull for use with a zipper having a hidden closure member such as a drawstring cord. In accordance with a first preferred embodiment, a zipper assembly includes a pair of zipper tapes and a slider movable along the zipper tapes. A closure member and a zipper pull are connected to the slider. A cover for the zipper pull includes a housing having an aperture formed therein. A plunger rod having a first end and a second end is connected to the zipper pull, with its first end extending outwardly through the aperture. A biasing member biases the plunger rod outwardly from the aperture in a static condition.

In accordance with another preferred embodiment, a zipper assembly includes an opposed pair of zipper tapes. Each zipper tape has an exterior surface and an interior surface and a plurality of teeth, with the teeth exposed on the interior surfaces of the zipper tapes. A slider is movable along the zipper tapes and includes an outer plate riding along the exterior surfaces of the zipper tapes and an inner plate riding along the interior surfaces of the zipper tapes. A drawstring is connected to the inner plate and a zipper pull is connected to the outer plate. A cover for the zipper pull includes a housing having an aperture formed therein. A plunger rod has a first end and a second end and is connected to the zipper pull, with the first end extending outwardly through the aperture. A spring biases the plunger rod outwardly from the aperture in a static condition.

In accordance with a further embodiment, a zipper assembly includes a pair of zipper tapes having teeth that engage one another, an exterior surface and an interior surface, with the teeth exposed on the interior surfaces of the zipper tapes. A slider is movable along the zipper tapes and includes an outer plate riding along the exterior surfaces of the zipper tapes and an inner plate riding along the interior surfaces of the zipper tapes. A drawstring is connected to the inner plate and a zipper pull is pivotally connected to the outer plate. A cover for the zipper pull includes a housing having an inner portion, an outer portion, and an interior wall positioned within the outer portion. The outer portion has an aperture formed in an end wall thereof and a plurality of recesses formed therein. The inner portion has a plurality of fingers, with each finger received in a corresponding recess. The interior wall has an aperture formed therein and a bracket receives a portion of the zipper pull. A plunger rod has a first end and a second end and is connected to the bracket, with the first end extending outwardly through the aperture in the end wall and the second end extending through the aperture in the interior wall. A cap is positioned on the first end of the plunger rod, and has a flange that abuts an interior surface of the outer portion. A spring has a first end and a second end and is positioned about the plunger rod, with the first end abutting the end wall of the outer portion and the second end abutting the interior wall. The spring biases the first end of the plunger rod outwardly from the aperture in the end wall in a static condition.

Substantial advantage is achieved by providing a covered zipper pull. In particular, certain preferred embodiments of the present invention allow the use of zipper assembly with a hidden drawstring cord without the distraction and discomfort associated with an exposed zipper pull.

These and additional features and advantages of the invention disclosed here will be further understood from the following detailed disclosure of certain preferred embodiments.

Figure 1:
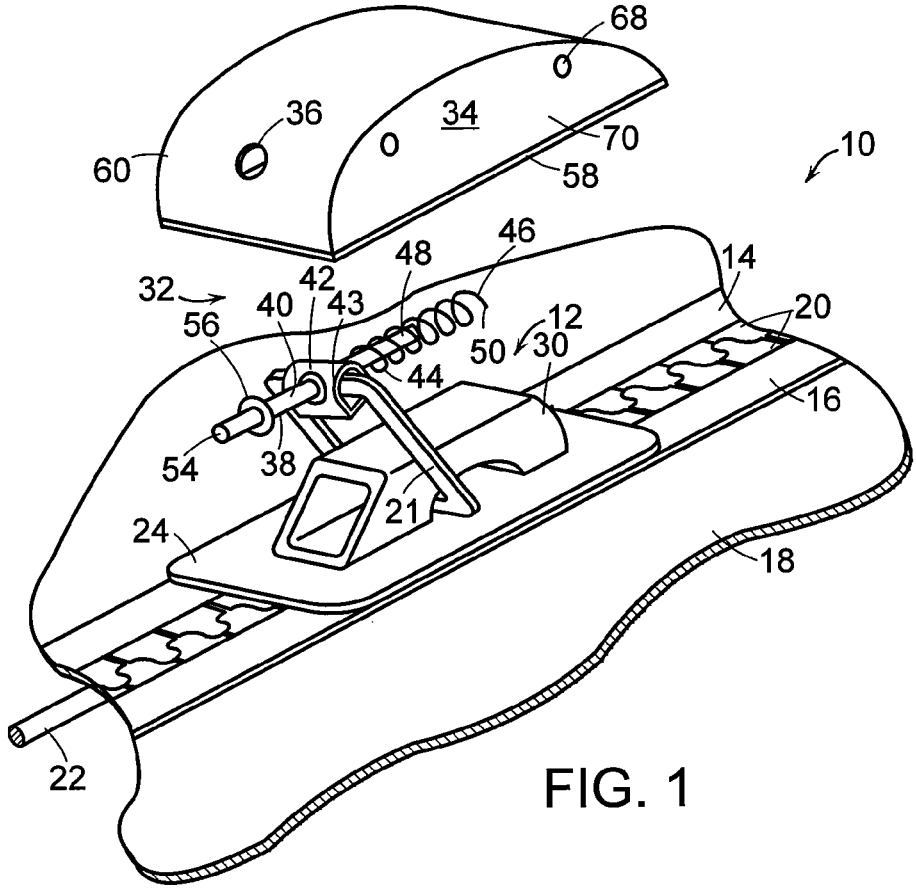
FIG. 1 is a perspective view, in exploded form, of a covered locking zipper pull in accordance with a preferred embodiment of the present invention, shown in use with a hidden drawstring cord.

The figures referred to above are not drawn necessarily to scale and should be understood to provide a representation of the invention, illustrative of the principles involved. Some features of the covered zipper pull depicted in the drawings have been enlarged or distorted relative to others to facilitate explanation and understanding. The same reference numbers are used in the drawings for similar or identical components and features shown in various alternative embodiments. Covered zipper pulls as disclosed herein would have configurations and components determined, in part, by the intended application and environment in which they are used.

DETAILED DESCRIPTION OF CERTAIN PREFERRED EMBODIMENTS

Figure 2:
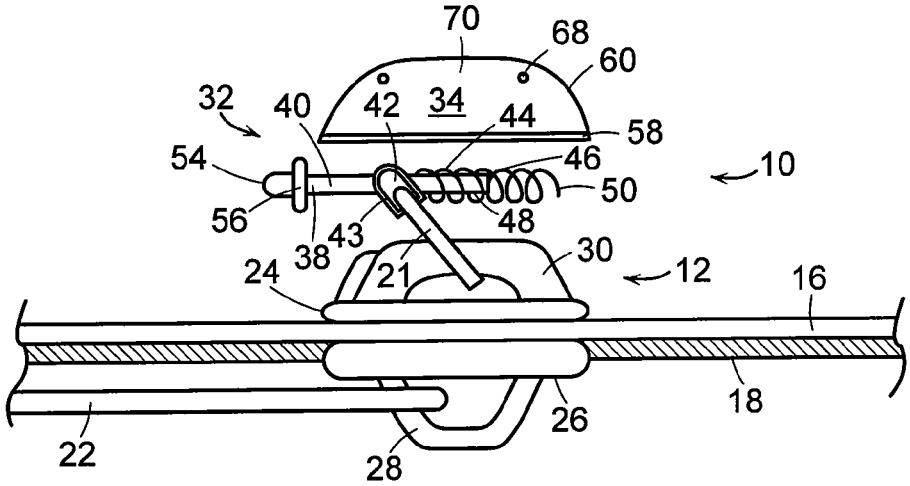
FIG. 2 is an elevation view of the covered locking zipper pull of FIG. 1, shown in an assembled condition.

The present invention may be embodied in various forms. A preferred embodiment of a covered zipper assembly 10 is shown in FIGS. 1–2. Zipper assembly 10 includes a slider 12 positioned between a pair of opposed zipper tapes 14, 16 secured along edges thereof to an article of apparel 18. Although zipper assembly 10 is illustrated here as being used in connection with an article of apparel 18, it is to be appreciated that zipper assembly 10 is suitable for use for any object with an opening covered by a zipper, such as, for example, a backpack or a duffle bag.

Each of zipper tapes 14, 16 includes a plurality of zipper teeth 20 that engage one another to secure zipper assembly 10. A zipper pull 21 is pivotally secured to slider 12. In a preferred embodiment, zipper pull 21 is a locking zipper pull. Thus, zipper pull 21 must be pivoted upwardly out of its locked position in order to move slider 12 along zipper tapes 14, 16. A closure member 22 is secured to slider 12 on an interior side of article of apparel 18. As slider 12 moves back and forth along zipper tapes 14, 16, closure member 22 acts to open and close or adjust another portion of article of apparel 18. For example, in the illustrated embodiment, closure member 22 is a drawstring 22, which may be used to tighten and loosen a hood about a user's face.

Zipper assembly 10 may be a concealed or hidden zipper, in which a leading edge of slider 12 opens or separates the zipper tapes as it moves along zipper tapes 14, 16, while its trailing edge rejoins or closes the zipper tapes. Thus, zipper assembly 10 remains sealed on both the leading and trailing edges as slider 12 moves in either direction along zipper tapes 14, 16, protecting the interior of zipper assembly 10 and article of apparel 20.

In the illustrated embodiment, slider 12 includes an outer plate 24 riding along an exterior surface of zipper tapes 14, 16, and an inner plate 26 riding along an interior surface of zipper tapes 14, 16. Drawstring 22 is connected to a loop 28 formed on inner plate 26. Zipper pull 21 is pivotally connected to a loop 30 formed on outer plate 24. As slider 12 moves along zipper tapes 14, 16, drawstring 22 is tightened and loosened accordingly. Drawstring 22 is preferably positioned on the interior side of article of apparel 18, thereby preventing it from getting caught or tangled on other items or otherwise presenting a nuisance to the user.

Figure 3:
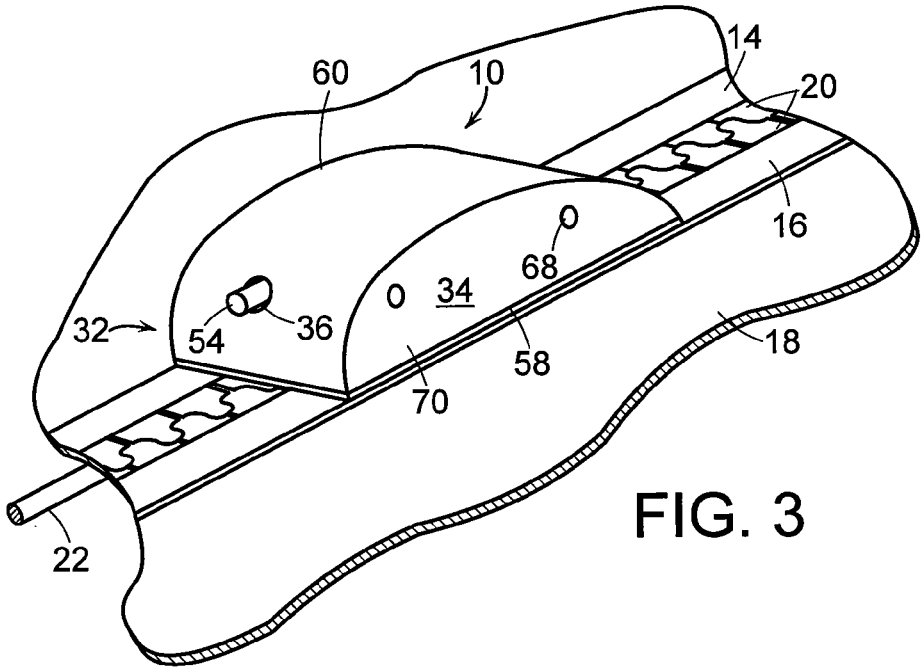
FIG. 3 is a perspective view of the covered locking zipper pull of FIG. 1, shown in an assembled condition.
Figure 4:
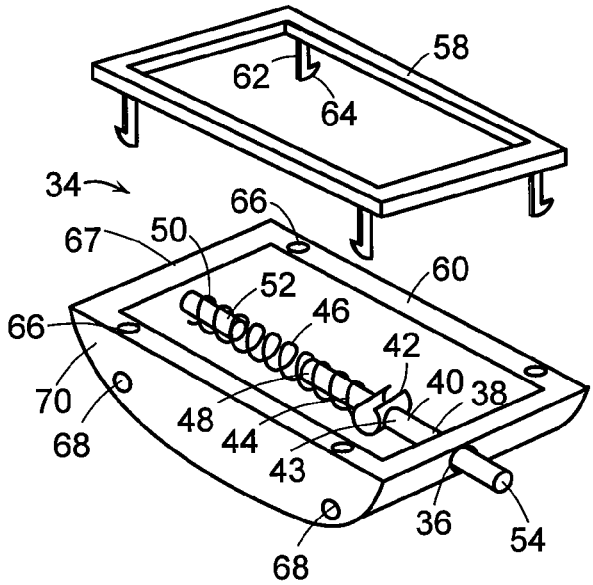
FIG. 4 is a perspective view, in exploded form, of a preferred embodiment of the cover of the covered locking zipper pull of FIG. 1.

A cover assembly 32 is provided for zipper assembly 10, as seen in exploded fashion in FIGS. 1, 2 and 4, and in its assembled condition in FIG. 3. Cover assembly 32 includes a housing 34 with an aperture 36 formed in housing 34. A first end 38 of a plunger rod 40 extends through aperture 36 and is pivotally secured by way of a bracket 42 to zipper pull 21. In the illustrated embodiment, plunger rod 40 is substantially cylindrical and bracket 42 includes a substantially C-shaped portion 43 that receives a portion of zipper pull 21 in snap-fit fashion. A first end 44 of a spring 46 is seated on a second end 48 of plunger rod 40. A second end 50 of spring 46 is seated on a support rod 52 extending inwardly from an interior surface of housing 34. Spring 46 abuts bracket 42 and serves to bias plunger rod 40 outwardly through aperture 40 in a first or static condition. In a preferred embodiment, a cap 54 having a flange 56 extending outwardly about its base is provided on first end 38 of plunger rod 40. Cap 54 extends outwardly through aperture 36, with flange 56 abutting an interior edge of aperture 36 to restrict the outward travel of plunger rod 40. It is to be appreciated that other types of biasing members other than a coil spring could be used to bias plunger rod 38 outwardly from housing 34.

In a preferred embodiment, as seen in FIG. 4, housing 34 includes an inner portion 58 and an outer portion 60. A plurality of fingers 62 extend outwardly from inner portion 58, with barbs 64 provided on the ends of fingers 62. A plurality of recesses 66 are formed in a base 67 of outer portion 60, with apertures 68 extending through side walls 70 of outer portion 60 into recesses 66 such that recesses 66 are in fluid communication with an exterior of outer portion 60 by way of apertures 68. Each finger 62 is received in a corresponding recess 66, with each barb 64 engaging an aperture 68 in a side wall 70, thereby locking outer portion 60 to inner portion 58. To release outer portion 60 and inner portion 58 from one another, a pin or other small diameter object can be inserted into apertures 68 such that each barb 64 is pressed inwardly out of engagement with apertures 68, allowing fingers 62 to be pulled outwardly from recesses 66.

To operate zipper assembly 10, a user grasps outer portion 60 between their fingers and depresses cap 54 against the biasing action of spring 46. Plunger rod 40, which is engaged to zipper pull 21 by way of bracket 42, is pressed inwardly into housing 34 in this second, operating condition to pivot zipper pull 21 out of engagement with zipper tapes 14, 16. Slider 12 is now free to move along zipper tapes 14, 16 in either direction. The user can then simply move slider 12 in either direction by continuing to grasp outer portion 60 and pushing slider 12 in the desired direction. As long as cap 54 is depressed, zipper pull 21 is in its disengaged position with respect to slider 12 and teeth 20 of zipper tapes 14, 16, allowing slider 12 to move freely. Once slider 12 has moved sufficiently, e.g., when drawstring 22 is tightened or loosened a desired amount, the user releases cap 54 and spring 46 biases plunger rod 40 outwardly. Zipper pull 21 is naturally forced back into engagement with teeth 20, locking zipper assembly 10.

Figure 5:
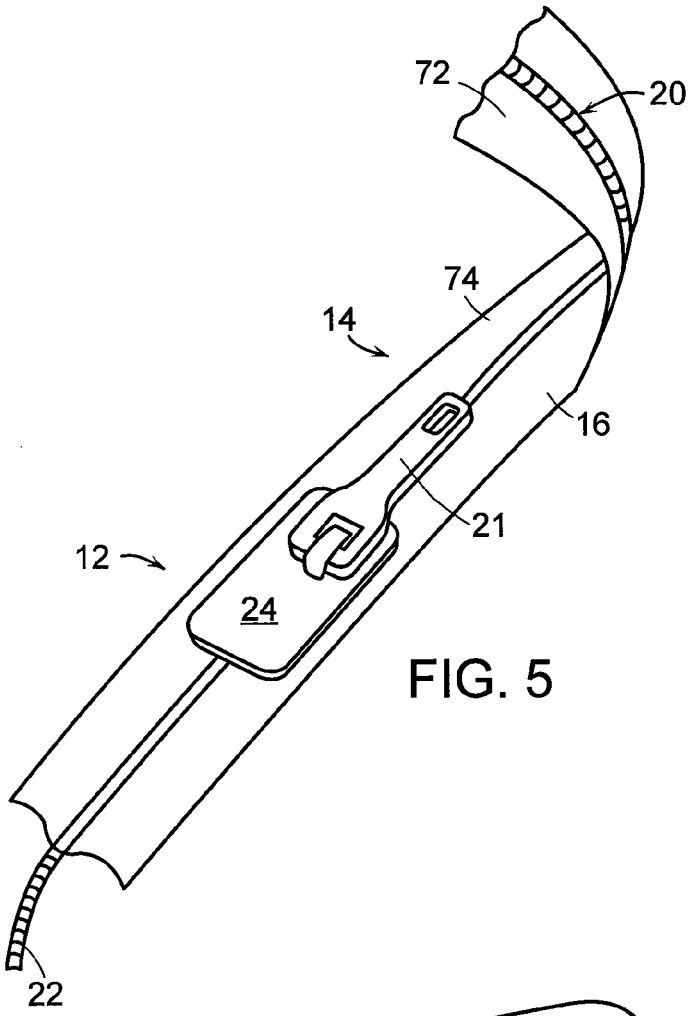
FIG. 5 is a perspective view of sealed zipper used in accordance with certain preferred embodiments of the present invention.

Another preferred embodiment is shown in FIGS. 5–9 in which teeth 20 of zipper tapes 14, 16 are exposed only on an interior surface 72 thereof, while an exterior surface 74 of zipper tapes 14, 16 presents a substantially smooth appearance. Thus, outer plate 24 will ride along the smooth exterior surface 74 of zipper tapes 14, 16, presenting an aesthetically pleasing appearance. As seen in FIG. 5, zipper pull 21 is in its locked condition with respect to slider 12.

Figure 6:
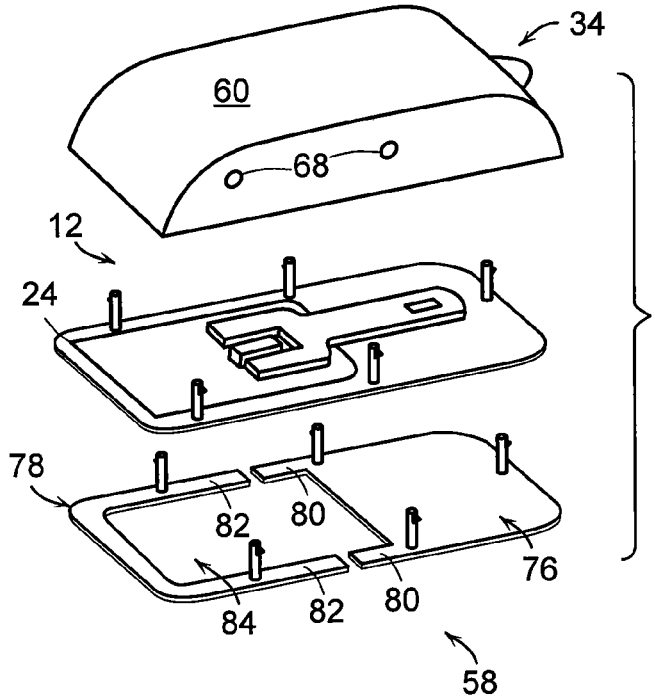
FIG. 6 is an exploded perspective view of the slider of the zipper of FIG. 5 shown with an alternative embodiment of a zipper cover.

As seen in FIG. 6, outer plate 24 is sandwiched between inner portion 58 and outer portion 60 of housing 34. In the illustrated embodiment, inner portion 58 is formed of a first portion 76 and a second portion 78. First portion 76 is substantially planar with a pair of flanges 80 extending outwardly from one edge thereof. Second portion 78 is a substantially U-shaped member, with ends of arms 82 of the U-shaped portion abutting flanges 80 and defining an aperture 84 within which slider 12 is positioned.

Figure 7:
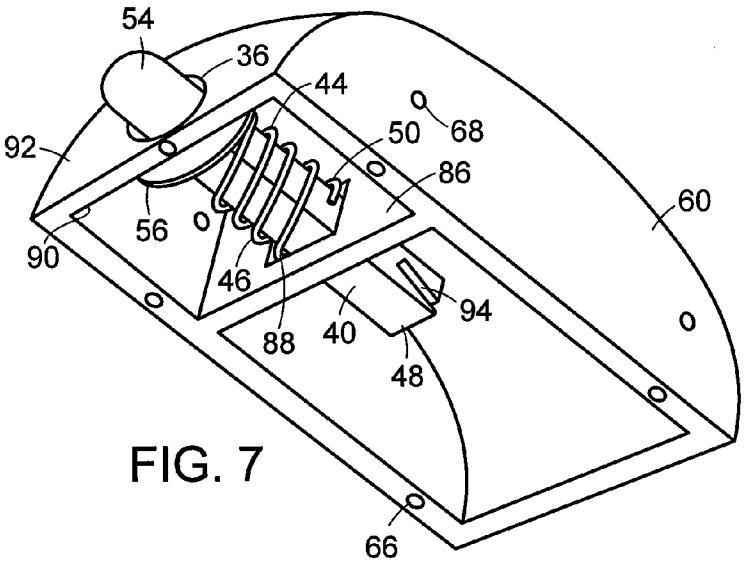
FIG. 7 is a perspective view of an interior of the outer portion of the cover of FIG. 6.

As seen in FIG. 7, an interior wall 86 is positioned within outer portion 60 and has an aperture 88 formed therein. Second end 48 of plunger rod 40 extends through aperture 88. In the illustrated embodiment, plunger rod 40 and aperture 88 are rectangular, or square in shape. It is to be appreciated that other suitable shapes for plunger rod 40 and aperture 88 will become readily apparent to those skilled in the art, given the benefit of this disclosure.

Figure 9:
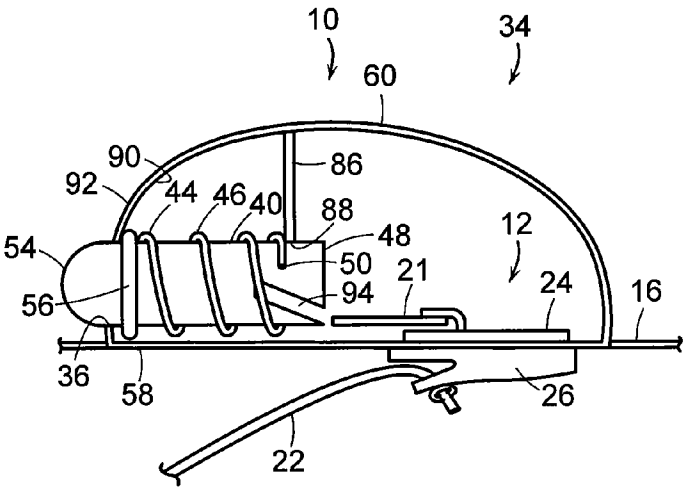
FIG. 9 is a section view of the cover of FIG. 6, shown in use with the slider of FIG. 5, with the plunger rod in its static condition and the zipper pull in a locked condition.
Figure 8:
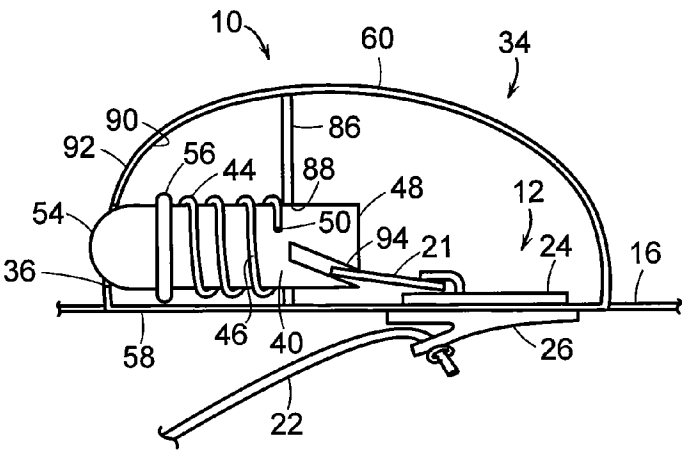
FIG. 8 is a section view of the cover of FIG. 6, shown in use with the slider of FIG. 5, with the plunger rod of the cover depressed and the zipper pull in an unlocked condition.

Spring 46 is positioned and compressed between interior wall 86 and an interior surface 90 of an end wall 92 of outer portion 60. A slot 94 is formed in second end 48 of plunger rod 40, extending upwardly and inwardly into plunger rod 40. As seen in FIGS. 8–9, slot 94 extends upwardly and away from slider 12. Slot 94 serves to receive zipper pull 21 and force it upwardly away from slider 12 into its unlocked position when plunger rod 40 is depressed within housing 34.

As seen in FIG. 9, plunger rod 40 is in its static condition with spring 46 biasing first end 38 of plunger rod 40 outwardly through aperture 36 in outer portion 60. In this condition, zipper pull 21 is in its locked position with respect to slider 12. As button 54 and, consequently, plunger rod 40 is depressed, zipper pull 21 is received by and forced upwardly by angled slot 94, thereby unlocking zipper pull 21 and allowing the user to move zipper assembly 10 in either direction along zipper tapes 14, 16.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A zipper assembly comprising, in combination:
- a pair of zipper tapes;
- a slider movable along the zipper tapes;
- a closure member secured to the slider;
- a zipper pull connected to the slider; and
- a cover for the zipper pull comprising:
  - a housing having an aperture formed therein;
  - a plunger rod having a first end and a second end and pivotally connected to the zipper pull, the first end extending outwardly through the aperture; and
  - a biasing member biasing the plunger rod outwardly from the aperture in a static condition.

2. The zipper assembly of claim 1, further comprising a cap positioned on the first end of the plunger rod, a portion of the cap extending through the aperture in the static condition.

3. The zipper assembly of claim 2, further comprising a flange at a base of the cap, the flange abutting an interior surface of the cover in the static condition.

4. The zipper assembly of claim 1, wherein the housing comprises an inner portion and an outer portion secured to the inner portion.

5. The zipper assembly of claim 4, wherein the outer portion includes a plurality of recesses and the inner portion includes a plurality of fingers, each finger received in a corresponding recess in the outer portion.

6. The zipper assembly of claim 5, wherein an end of each finger includes a barb.

7. The zipper assembly of claim 6, further comprising a plurality of apertures in the outer portion, each aperture extending from an exterior of the outer portion to a corresponding recess, a barb received in each aperture when the outer portion is secured to the inner portion.

8. The zipper assembly of claim 4, wherein the biasing member is a spring.

9. The zipper assembly of claim 8, wherein the housing further comprises an interior wall having an aperture formed therein, the spring surrounding the plunger rod and positioned between the interior wall and an end wall of the outer portion, the second end of the plunger rod extending through the aperture in the interior wall.

10. The zipper assembly of claim 9, wherein the plunger rod has a slot formed therein, the slot receiving a portion of the zipper pull when the zipper pull is moved, allowing the slider to move along the zipper tapes.

11. The zipper assembly of claim 10, wherein the slot is formed in the second end of the plunger rod and is angled upwardly and away from the slider such that the zipper pull is forced outwardly away from the slider when the first end of the plunger rod is depressed toward an interior of the housing.

12. The zipper assembly of claim 1, wherein the biasing member is a spring.

13. The zipper assembly of claim 12, wherein a first end of the spring receives the second end of the plunger rod.

14. The zipper assembly of claim 13, further comprising a support rod extending from an interior surface of the housing and receiving a second end of the spring.

15. The zipper assembly of claim 1, wherein the closure member is a drawstring.

16. The zipper assembly of claim 1, wherein the slider comprises an outer plate riding along an exterior surface of the zipper tapes and an inner plate riding along an interior surface of the zipper tapes.

17. The zipper assembly of claim 16, wherein the closure member is a drawstring, the drawstring connected to the inner plate.

18. The zipper assembly of claim 1, further comprising a bracket receiving a portion of the zipper pull, the plunger rod connected to the bracket, the biasing member engaging the bracket.

19. The zipper assembly of claim 1, wherein each of the zipper tapes has an interior surface and an exterior surface and a plurality of teeth along which the slider moves, the teeth of the zipper tapes exposed solely on the interior surface of the zipper tapes.

20. The zipper assembly of claim 1, wherein the zipper tapes are sealed on a leading side and trailing side of the slider as the slider moves along the zipper tapes.

21. A zipper assembly comprising, in combination:
- an opposed pair of zipper tapes, each zipper tape having an exterior surface and an interior surface and a plurality of teeth, the teeth exposed on the interior surfaces of the zipper tapes;
- a slider movable along the zipper tapes and including an outer plate riding along the exterior surfaces of the zipper tapes and an inner plate riding along the interior surfaces of the zipper tapes;
- a drawstring connected to the inner plate;
- a zipper pull connected to the outer plate; and
- a cover for the zipper pull comprising:
  - a housing having an aperture formed therein;
  - a plunger rod having a first end and a second end and pivotally connected to the zipper pull, the first end extending outwardly through the aperture; and
  - a spring biasing the plunger rod outwardly from the aperture in a static condition.

22. The zipper assembly of claim 21, wherein the housing comprises an inner portion and an outer portion secured to the inner portion.

23. The zipper assembly of claim 22, wherein the outer portion includes a plurality of recesses and the inner portion includes a plurality of fingers, each finger received in a corresponding recess in the outer portion.

24. The zipper assembly of claim 23, wherein an end of each finger includes a barb.

25. The zipper assembly of claim 24, further comprising a plurality of apertures in the outer portion, each aperture extending from an exterior of the outer portion to a corresponding recess, a barb received in each aperture when the outer portion is secured to the inner portion.

26. The zipper assembly of claim 21, further comprising a support rod extending from an interior surface of the housing, the spring seated on the support rod.

27. The zipper assembly of claim 21, wherein the housing further comprises an interior wall having an aperture formed therein, the spring surrounding the plunger rod and positioned between the interior wall and an end wall of the outer portion, the second end of the plunger rod extending through the aperture in the interior wall.

28. The zipper assembly of claim 27, wherein the zipper pull is a locking zipper pull, and the plunger rod has a slot formed therein, with the slot receiving a portion of the zipper pull when the zipper pull is in an unlocked position allowing the slider to move along the zipper tapes.

29. The zipper assembly of claim 28, wherein the slot is formed in the second end of the plunger rod and is angled upwardly and away from the slider such that the zipper pull is forced outwardly away from the slider when the first end of the plunger rod is depressed toward an interior of the housing.

30. A zipper assembly comprising, in combination:

a pair of zipper tapes having teeth that engage one another, an exterior surface and an interior surface, the teeth exposed on the interior surfaces of the zipper tapes;

a slider movable along the zipper tapes and including an outer plate riding along the exterior surfaces of the zipper tapes and an inner plate riding along the interior surfaces of the zipper tapes;

a drawstring connected to the inner plate;

a zipper pull pivotally connected to the outer plate; and a cover for the zipper pull comprising:

a housing including an inner portion, an outer portion, and an interior wall positioned within the outer portion, the outer portion having an aperture formed in an end wall thereof and a plurality of recesses formed therein, the inner portion having a plurality of fingers, each finger received in a corresponding recess, and the interior wall having an aperture formed therein;

a bracket receiving a portion of the zipper pull;

a plunger rod having a first end and a second end and connected to the bracket, the first end extending outwardly through the aperture in the end wall and the second end extending through the aperture in the interior wall;

a cap positioned on the first end of the plunger rod, the cap having a flange that abuts an interior surface of the outer portion;

a spring having a first end and a second end and positioned about the plunger rod, the first end abutting the end wall of the outer portion and the second end abutting the interior wall, the spring biasing the first end of the plunger rod outwardly from the aperture in the end wall in a static condition.

31. The zipper assembly of claim 30, wherein an end of each finger includes a barb.

32. The zipper assembly of claim 31, further comprising a plurality of apertures in the outer portion, each aperture extending from an exterior of the outer portion to a corresponding recess, a barb received in each aperture when the outer portion is secured to the inner portion.

* * * * *